US009399539B2

(12) United States Patent
Meyer et al.

(10) Patent No.: US 9,399,539 B2
(45) Date of Patent: Jul. 26, 2016

(54) PACKAGING WRAP FOR HANGERS

(71) Applicant: TARGET BRANDS, INC., Minneapolis, MN (US)

(72) Inventors: Scott Meyer, Waconia, MN (US); Timothy M. Magner, Champlin, MN (US)

(73) Assignee: Target Brands, Inc., Minneapolis, MN (US)

( * ) Notice: Subject to any disclaimer, the term of this patent is extended or adjusted under 35 U.S.C. 154(b) by 354 days.

(21) Appl. No.: 14/171,041

(22) Filed: Feb. 3, 2014

(65) Prior Publication Data

US 2015/0217917 A1 Aug. 6, 2015

(51) Int. Cl.

| | |
|---|---|
| ***B65D 85/00*** | (2006.01) |
| ***B65D 71/46*** | (2006.01) |
| ***B65B 11/00*** | (2006.01) |
| ***B65D 59/04*** | (2006.01) |
| *A47G 25/14* | (2006.01) |

(52) U.S. Cl.

CPC ..... *B65D 71/46* (2013.01); *B65B 11/004* (2013.01); *B65D 59/04* (2013.01); *B65D 85/54* (2013.01); *A47G 25/1464* (2013.01); *B65D 2571/0066* (2013.01)

(58) Field of Classification Search

CPC ..... B65D 71/46; B65D 85/54; B65D 2571/0066; A47G 25/1664; A47G 25/1442

USPC ..... 206/279, 300, 348, 443; 223/85, 88; 229/87.01, 87.06

See application file for complete search history.

(56) References Cited

U.S. PATENT DOCUMENTS

| | | | | |
|---|---|---|---|---|
| 2,976,990 | A * | 3/1961 | Nevai | B65D 71/46 206/300 |
| 3,095,958 | A | 7/1963 | Whitman | |
| 3,115,968 | A | 12/1963 | Peterson | |
| 3,123,213 | A * | 3/1964 | Nevai | B65D 71/46 206/158 |
| 3,357,544 | A * | 12/1967 | Gingher | B65D 5/2038 206/300 |
| 3,814,008 | A | 6/1974 | Beshara | |
| 6,772,880 | B2 * | 8/2004 | Beverly | B65D 71/40 206/300 |
| 7,370,779 | B1 * | 5/2008 | Dunkirk | A47G 25/1442 223/98 |

(Continued)

OTHER PUBLICATIONS

"Attachable Hanger 6-pk.," printed from http://www.target.com/p/attachable-hanger-6-pk/-/A-11740825#prodSlot=medium_1_12&term=RE+hangers, publicly available at least as early as Jan. 29, 2012, per http://web.archive.org (3 pages).

(Continued)

*Primary Examiner* — Luan K Bui

(74) *Attorney, Agent, or Firm* — JoAnn M. Seaton; Griffiths & Seaton PLLC

(57) ABSTRACT

A packaging wrap for hangers includes a first side and a second side. The first side includes a first bottom panel, a first front panel, a first top panel, and a first rear panel. The first side is folded to define a first closed loop with an opening extending therethrough between the first bottom panel, the first front panel, the first top panel, and the first rear panel. The second side includes a second bottom panel, a second front panel, a second top panel, and a second rear panel. The second side is folded to define a second closed loop with an opening extending therethrough between the second bottom panel, the second front panel, the second top panel, and the first rear panel. The first side is coupled to the second side via a fold line extending along a boundary between the first bottom panel and the second bottom panel.

17 Claims, 12 Drawing Sheets

(56) References Cited

U.S. PATENT DOCUMENTS

| | | | | |
|---|---|---|---|---|
| 8,201,685 | B1 * | 6/2012 | Licari | B65D 71/08 206/300 |
| 2001/0015363 | A1 | 8/2001 | Rahmey | |
| 2004/0035724 | A1 * | 2/2004 | Gomez | A47G 25/1464 206/284 |
| 2006/0191966 | A1 * | 8/2006 | DeBroeck | A47G 25/06 223/85 |

OTHER PUBLICATIONS

"Delta Hangers—White," printed from http://www.target.com/p/delta-hangers-white/-/A-12903443#prodSlot=medium_2_4&term=hanger, publicly available at least as early as Nov. 5, 2011, per http://web.archive.org (3 pages).

"Kids' 18-pk. Hangers," printed from http://www.target.com/p/kids-18-pk-hangers/-/A-11740820#prodSlot=medium_1_1&term=Kids%27+18-pk+Hangers, publicly available at least as early as Sep. 27, 2011, per http://web.archive.org (3 pages).

"Multipurpose Hangers 10-pk.—White," printed from http://www.target.com/p/multipurpose-hangers-10-pk-white/-/A-11740818#prodSlot=medium_1_11&term=RE+hangers, publicly available at least as early as Mar. 21, 2012, per http://web.archive.org (3 pages).

Office Action from Canadian Patent Application No. 2,846,991, mailed Aug. 18, 2014 (3 pages).

Office Action from Canadian Patent Application No. 2,846,991, mailed Dec. 8, 2014 (3 pages).

* cited by examiner

PACKAGING WRAP FOR HANGERS

BACKGROUND OF THE INVENTION

Retail packaging is a continuously evolving and important part of providing retail products as well as marketing for those products. As green initiatives grow, packaging trends move toward using recyclable materials and/or simpler packaging options. In addition, when manufacturing products, even relatively small cost savings per package obtained by either using less material, simplified packaging assembly, simplified coupling of products to packaging, etc. are substantial when multiplied by the thousands, hundreds of thousands, or even higher quantities of a package run for a particular product offering.

The desire for cost savings and green solutions is counterbalanced against a desire for the packaging to provide an aesthetically pleasing look while additionally providing areas to receive copy describing the product, brand, preferred use, etc. Packaging is often the first and/or most direct line of marketing to potential consumer, which increases the importance of packaged product aesthetics.

SUMMARY OF THE INVENTION

One aspect of the present invention relates to a packaging wrap for hangers. The packaging wrap includes a first side and a second side. The first side includes a first bottom panel, a first front panel, a first top panel, and a first rear panel. The first front panel extends between the first bottom panel and the first top panel, the first top panel extends between the first front panel and the first rear panel, and the first side is folded to define a first closed loop with a first opening extending therethrough between the first bottom panel, the first front panel, the first top panel, and the first rear panel. The second side includes a second bottom panel, a second front panel, a second top panel, and a second rear panel. The second front panel extends between the second bottom panel and the second top panel, the second top panel extends between the second front panel and the second rear panel, and the second side is folded to define a second closed loop with a second opening extending therethrough between the second bottom panel, the second front panel, the second top panel, and the first rear panel. The first side is coupled to the second side via a fold line extending along a boundary between the first bottom panel and the second bottom panel. Other combinations, packages, packaged hangers apparatus, assemblies, and associated methods are also disclosed.

BRIEF DESCRIPTION OF THE DRAWINGS

Embodiments of the invention will be described with respect to the figures, in which like reference numerals denote like elements, and in which.

DETAILED DESCRIPTION

Figure 1:
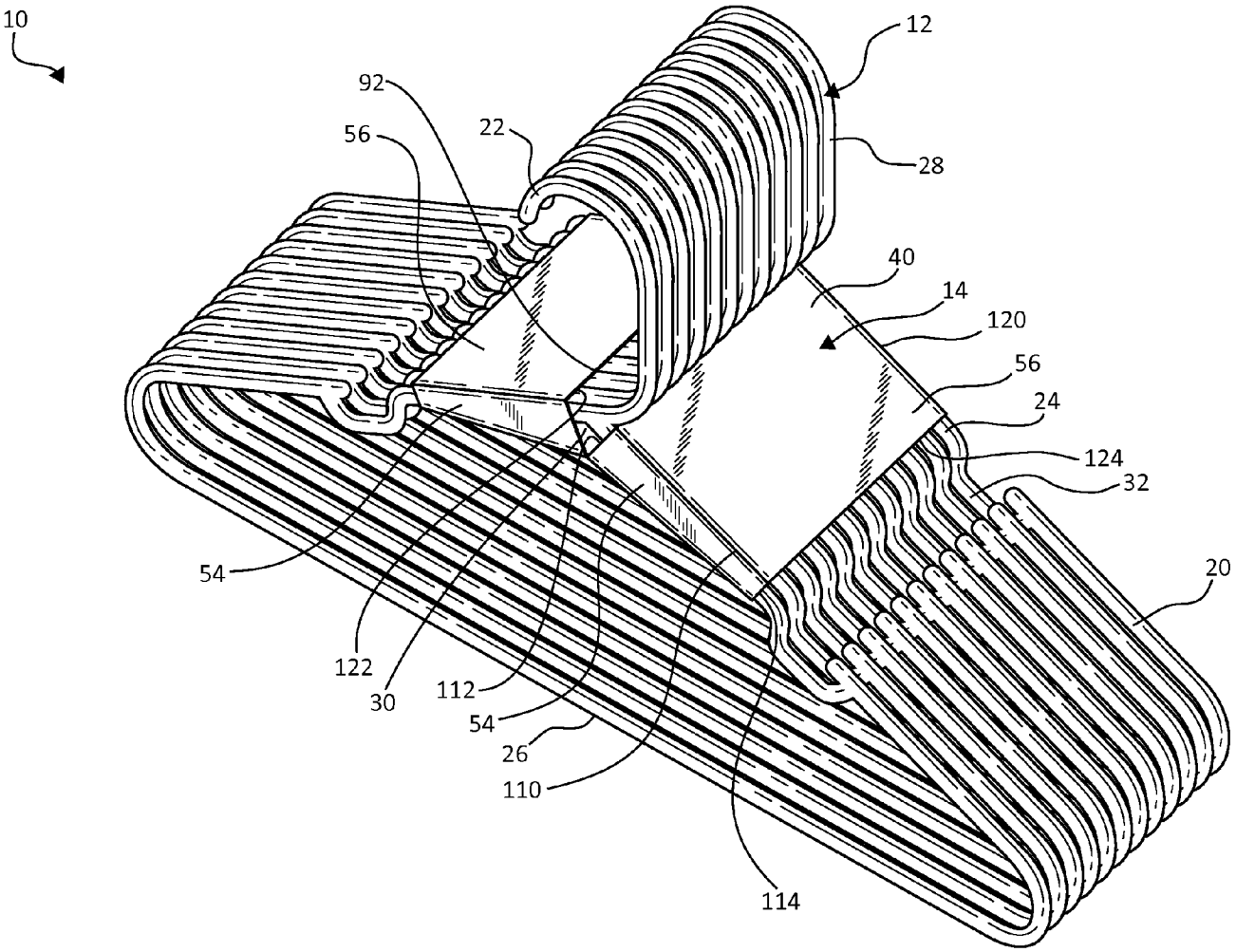
FIG. 1 is a front perspective view illustration of packaged hangers, according to one embodiment of the present invention.
Figure 2:
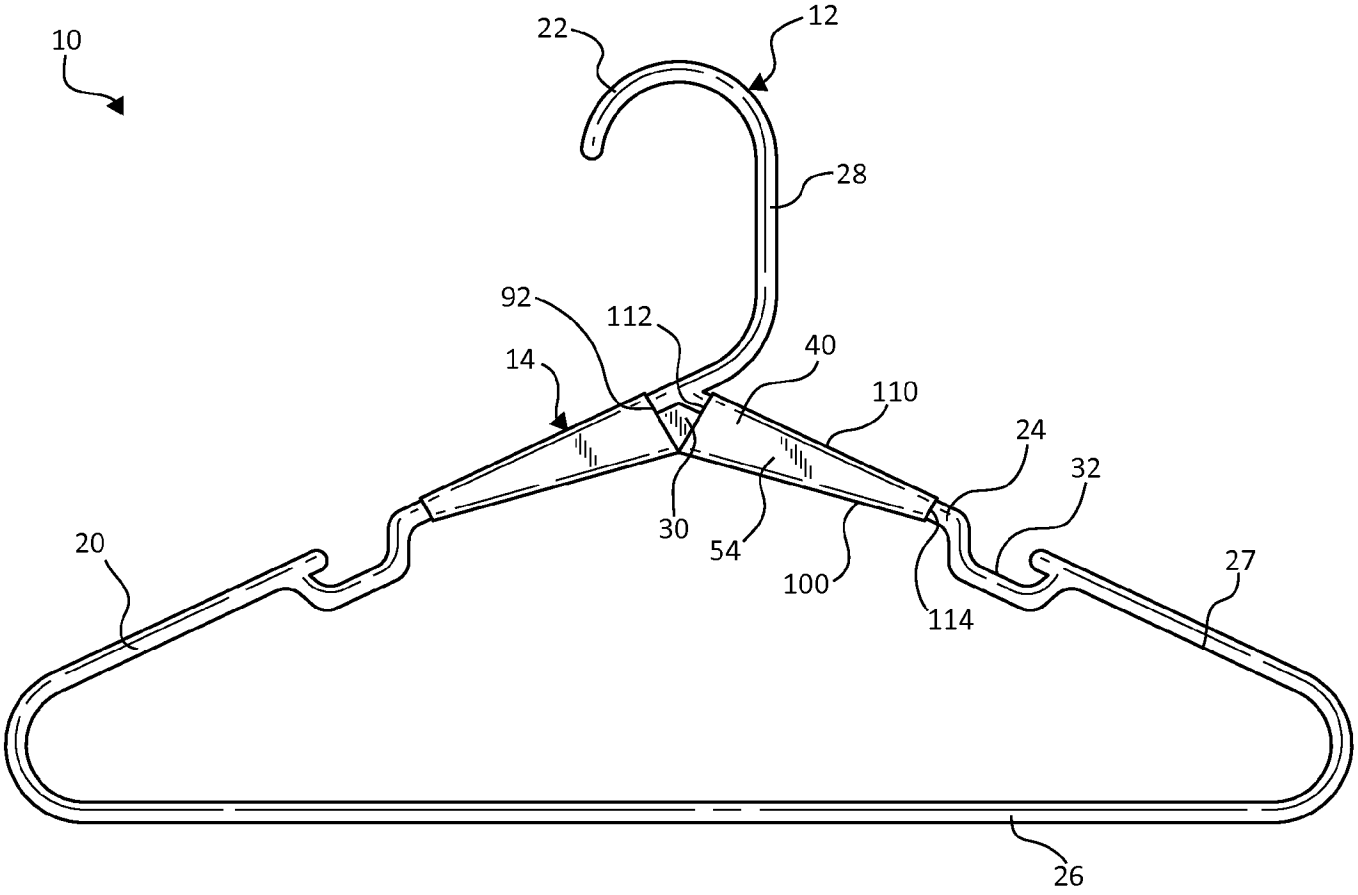
FIG. 2 is a front view illustration of the packaged hangers, according to one embodiment of the present invention.
Figure 3:
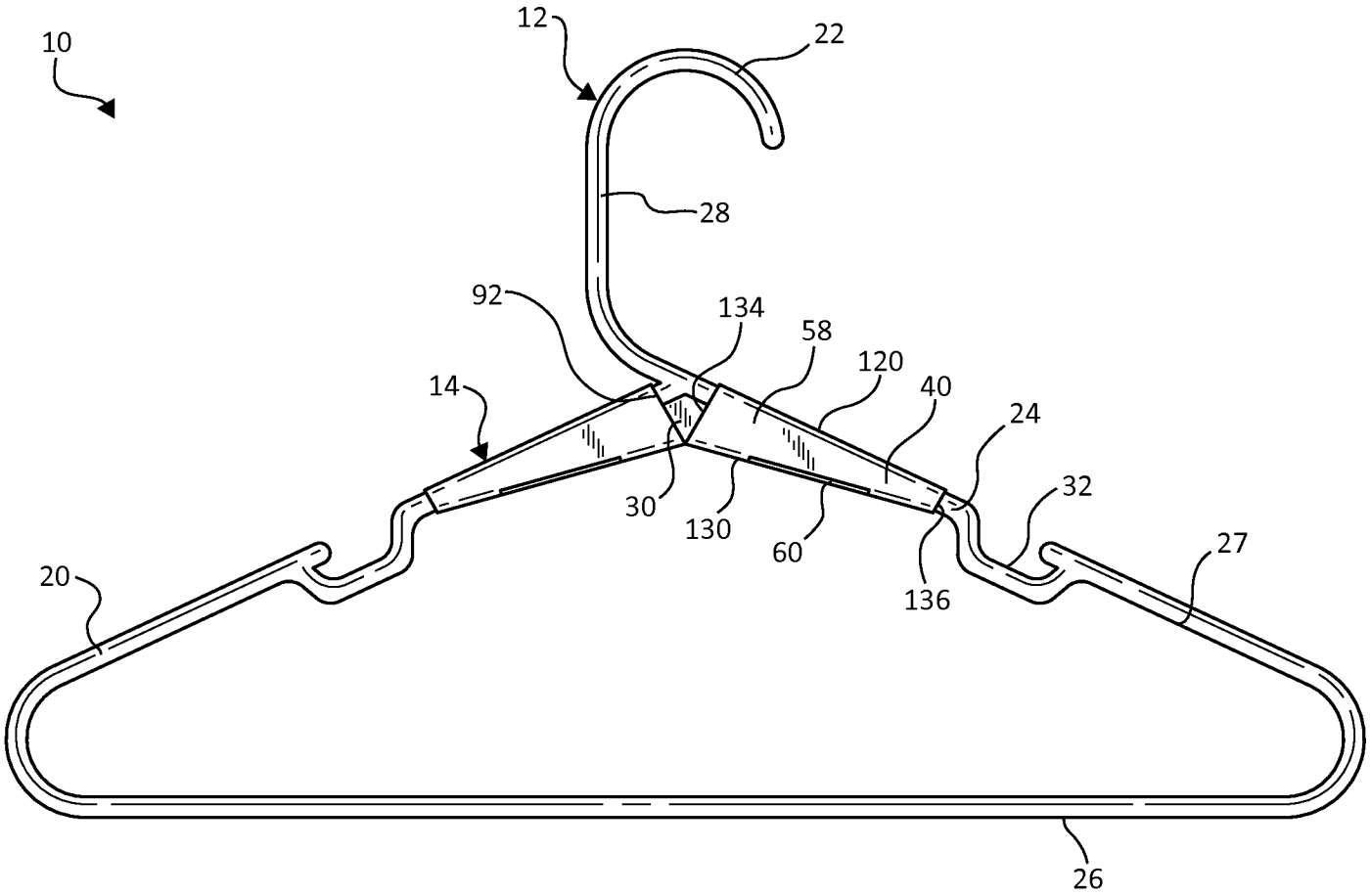
FIG. 3 is a rear view illustration of the packaged hangers, according to one embodiment of the present invention.
Figure 5:
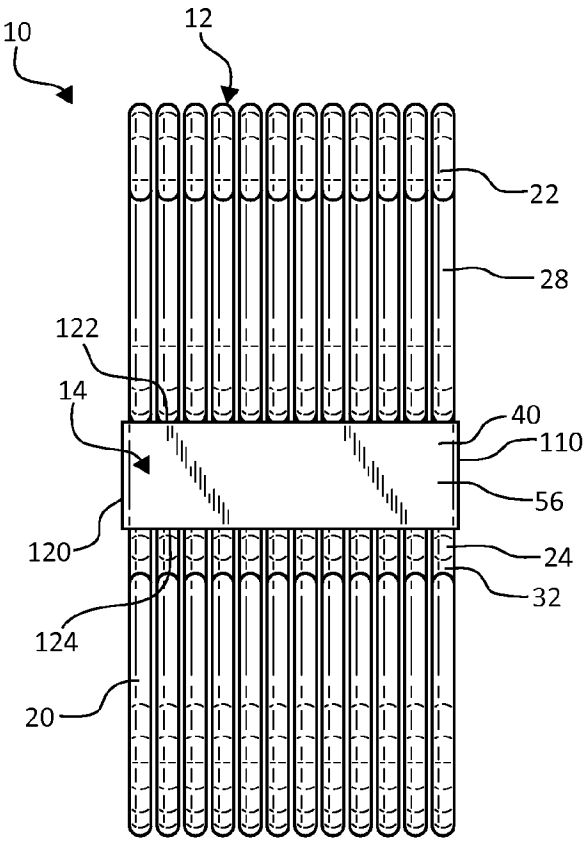
FIG. 5 is a left side view illustration of the packaged hangers, according to one embodiment of the present invention.
Figure 4:
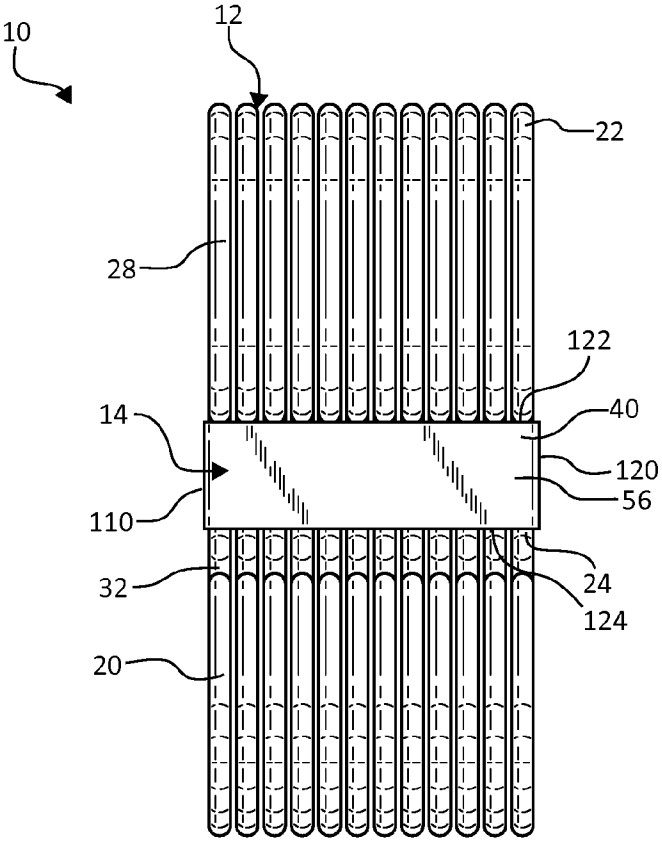
FIG. 4 is a right side view illustration of the packaged hangers, according to one embodiment of the present invention.
Figure 6:
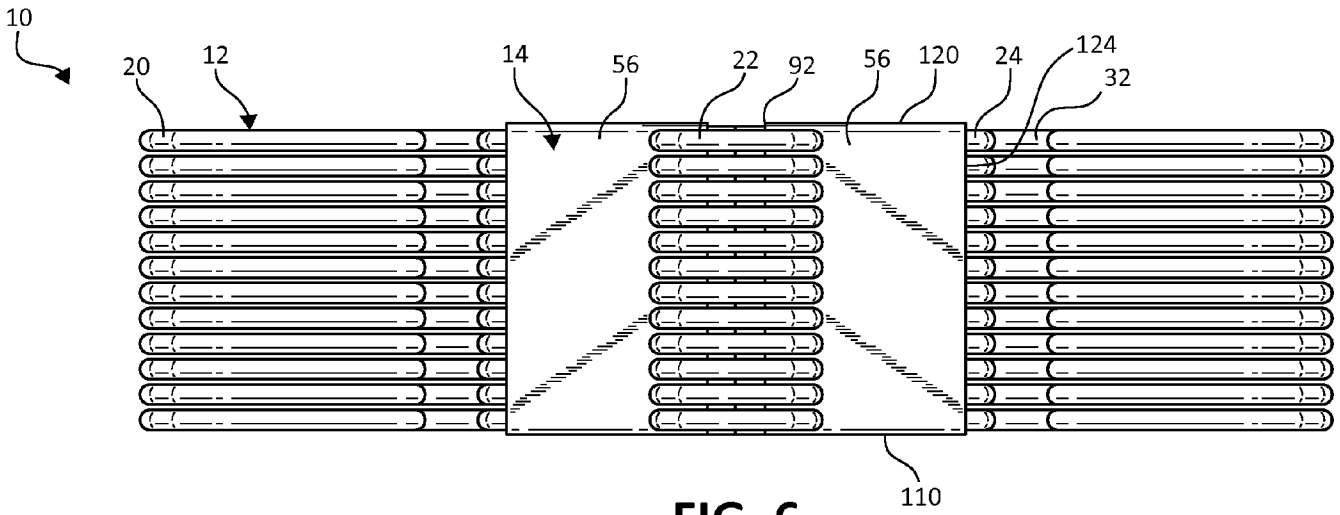
FIG. 6 is a top view illustration of the packaged hangers, according to one embodiment of the present invention.
Figure 7:
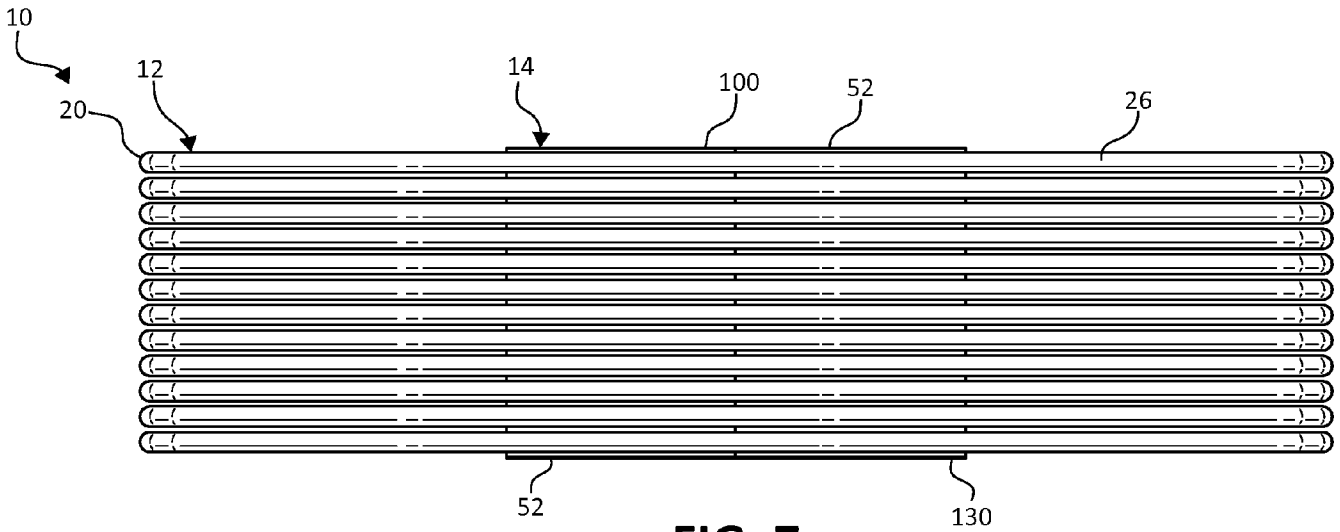
FIG. 7 is a bottom view illustration of the packaged hangers, according to one embodiment of the present invention.

Clothes hangers are widely used for storing and hanging a variety of clothing items. Plastic hangers, which are relatively inexpensive yet fairly sturdy, are a very common variety of hanger and are typically sold in a package including a plurality of hangers, e.g., six, twelve, or eighteen hangers. A packaging wrap or sleeve according to the present invention is configured to encircle shoulder portions of a stack of hangers on either side of the hooks of the stack of hangers. The packaging wrap is substantially formed of a single piece of a planar material folded around the two shoulder portions and secured to itself. As such, the resultant packaged hangers provide a number of hangers in a single package for sale and/or storage while leaving the hooks of the hangers exposed such that the packaged hangers can be hung on a support rod without removing the packaging wrap.

Turning to the figures, FIGS. 1-7 illustrate one embodiment of hanger package 10 including a plurality of hangers 12 and a packaging sleeve or packaging wrap 14, which maintains all of the plurality of hangers 12 as a single unit for sale or storage. Each one of the plurality of hangers 12 is substantially identical to the other ones of the plurality of hangers 12 and may take on a number of variations as can be seen on the hanger market today. In one embodiment, each of the plurality of hangers 12 includes a body 20 and a hook 22 extending upwardly therefrom. Body 20 is generally in the form of a triangular loop, in one example, in a manner defining shoulders 24 near the top vertex of the triangular loop, a crossbar 26 along a lower portion thereof, and an opening 27 formed between shoulders 24 and crossbar 26. In one example, an additional apex support 30 extends downwardly from the apex, i.e., the intersection between shoulders 24, to a bottom edge 34 opposite the apex to strengthen each of the plurality of hangers 12. In one example, indentations 32 are formed about half way down each of shoulders for receiving hanging aids (not shown) on clothing items, etc. Hook 22 includes a neck 28 extending from an intersection between shoulders 24 away from crossbar 26 to space a remainder of hook 22 from body 20.

Figure 8:
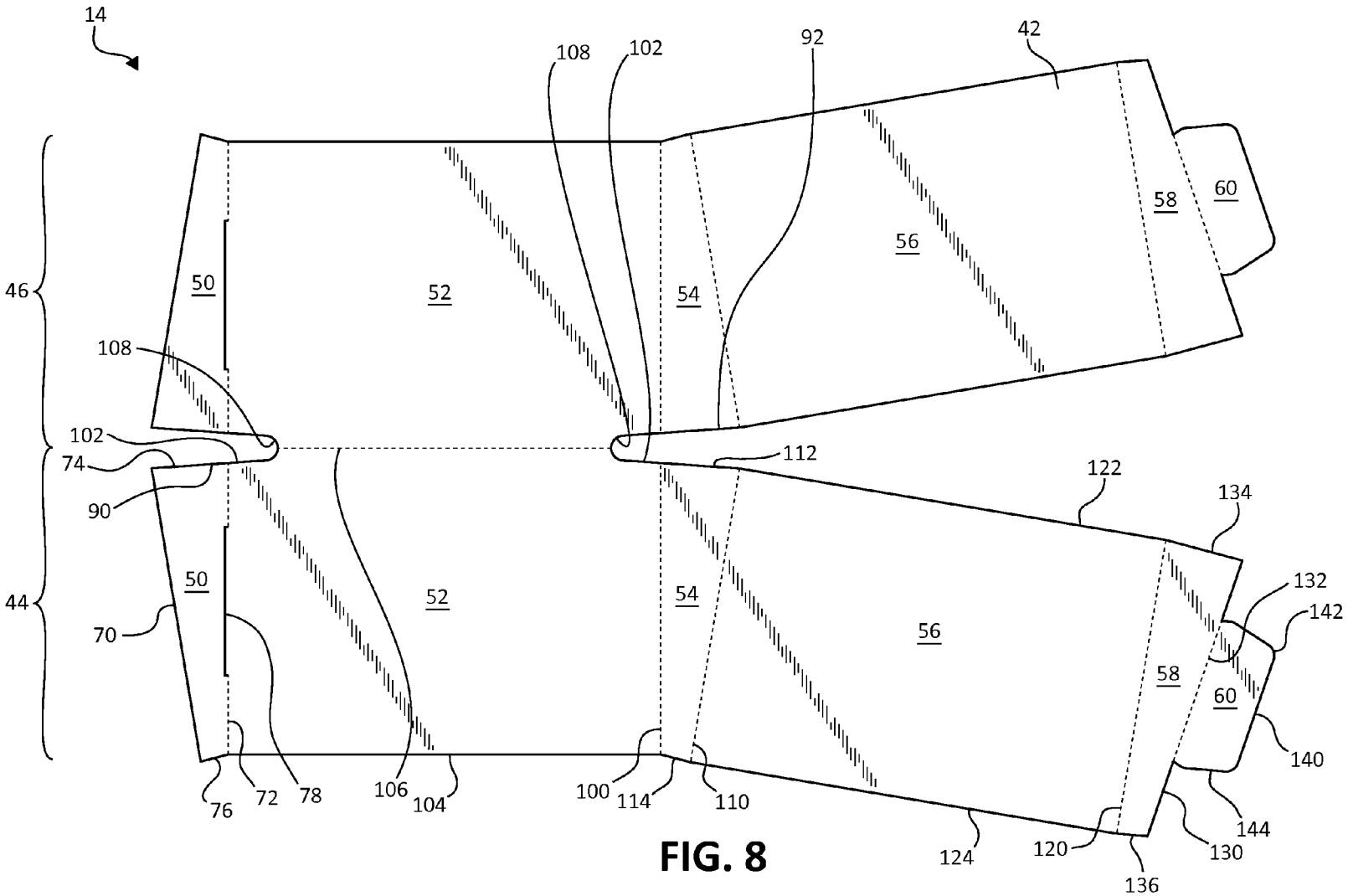
FIG. 8 is a front view illustration of an unfolded packaging wrap, according to one embodiment of the present invention.

Packaging wrap 14 is formed of a single piece of a substantially planar yet foldable material such as cardboard, paperboard, chipboard, plastic, etc., in one example, as illustrated in an unfolded state in FIG. 8, and defines a first or exterior surface 40 and a second or interior surface 42 opposite exterior surface 40. Packaging wrap 14 is substantially symmetrical defining a first side 44 and a second side 46, which is substantially a mirror image of first side 44. Packaging wrap 14 receives the plurality of hangers 12 substantially identically on either side of hooks 22 via first side 44 and second side 46. Each side 44 and 46 of packaging wrap 14 includes (i.e., is divided into) an interior rear panel 50, a bottom panel 52, a front panel 54, a top panel 56, an exterior rear panel 58, and a securement tab 60, according to one embodiment of the present invention. In one embodiment, interior rear panel 50, bottom panel 52, front panel 54, top panel 56, exterior rear panel 58, and securement tab 60 are sequentially positioned in an end-to-end manner on each of first side 44 and second side 46 with each successive one of the panels being differentiated by one of more fold lines as will be described in additional detail below.

In one example, on first side 44 of packaging wrap 14, interior rear panel 50 extends from a free edge 70 to an opposing fold line 72 in a manner defining interior free edge 74 and an opposing exterior free edge 76 that are each substantially linear. Interior rear panel 50 extends a smaller distance along exterior free edge 76 than along interior free edge 74 in a manner corresponding with the angled slope of shoulders 24 of hangers 12 and/or the size of vertex support 30, if any. In one example, exterior free edge 76 angles outwardly rather than being perpendicular to fold line 72 to account for the sloping shoulder 24 of hangers 12 as will become apparent upon reading the remainder of this application. In one example, fold line 72 is interrupted in a middle portion thereof by a cut or slit 78 extending collinearly with fold line 72. In one embodiment, slit 78 extends along at least about 50% of a length of interior rear panel 50 along fold line 72.

Bottom panel 52 extends from fold line 72 to an opposing fold line 100, which, in one example, extends substantially parallel to fold line 72, a distance substantially equal to a depth of the stack of hangers 12 measured from a front of the frontmost one of hangers 12 to a back of the rearmost one of hangers 12. Bottom panel 52 defines an interior free edge 102 and an opposite exterior free edge 104, which each extend from fold line 72 to fold line 100 and are each a free edge not generally bordering any other portion of packaging wrap 14. In one example, interior free edge 102 is discontinuous as it is interrupted between two opposing ends by intermediate fold line 106 formed between and immediately adjacent to each of two bordering bottom panels 52. In one embodiment, packaging wrap 14 is substantially symmetrical about a linear line extending collinearly with and on either side of fold line 106 thereby dividing packaging wrap 14 into first side 44 and second side 46. In one example, free portions of interior free edge 102 are formed on each side of the two bordering bottom panels 152 curving toward one another to meet at a vertex or intersection 108 in a curved and/or collectively U-shaped manner. As such, gaps are formed between sides 44 and 46 on either end of fold line 106, more particularly, a gap 90 is defined between interior free edges 74 and 102 of each side 44 and 46 of packaging wrap 14, and a gap 92 is defined between interior free edges 102, 112, 122, and 134 of each side 44 and 46 of packaging wrap 14.

Front panel 54 extends from bottom panel 52 opposite interior rear panel 50, for example, from fold line 100 to an opposite fold line 110. In one embodiment, a distance between fold lines 100 and 110 is substantially equal to or slightly greater than a distance between a bottom of apex support 30 and a top of hangers 12. Front panel 54 further defines an interior free edge 112 and opposite exterior free edge 114 each extending between and to each of fold lines 100 and 110. In one example, exterior free edge 114 is shorter than interior free edge 112 such that fold lines 100 and 110 are angled relative to each other similar to corresponding top and bottom edges of shoulder 24 of hangers 12.

In one example, top panel 56 extends from front panel 54 opposite bottom panel 52, more specifically, from fold line 110 to an opposite fold line 120. In one embodiment, top panel 56 extends a distance measured between fold lines 110 and 120 substantially equal to a distance bottom panel 52 extends between fold lines 72 and 100, that is, for example, a width substantially equal to a width of the stack of hangers 12. Top panel 56 defines opposing exterior free edge 124 in a manner defining interior free edge 122, which each extend from fold line 110 to fold line 120. In one example, interior free edge 122 and exterior free edge 124 extend substantially parallel to one another, and/or fold line 110 and fold line 120 extend substantially parallel to each other and/or substantially perpendicularly to interior free edge 122 and exterior free edge 124.

Exterior rear panel 58 extends from top panel 56 opposite front panel 54, more particularly, from fold line 120 to an opposite free edge 130. In one embodiment, exterior rear panel has a height measured between fold lines 120 and 130 substantially equal to a height of front panel 54 defined between fold lines 100 and 110. Exterior rear panel 58 further defines an interior free edge 134 and opposite exterior free edge 136 each extending between and to each of fold line 120 and free edge 130. In one example, exterior free edge 136 is shorter than interior free edge 134 such that fold line 120 and free edge 130 are angled relative to each other similar to corresponding top and bottom edges of shoulder 24 of hangers 12.

In one embodiment, securement tab 60 extends from an end of exterior rear panel 58 opposite top panel 56. More specifically, in one example, a fold line 132 separates securement tab 60 from exterior rear panel 58 and interrupts free edge 130, which extends collinearly on either side of fold line 132. Securement tab 60 is substantially rectangular in shape forming a free edge 140 opposite and extending substantially parallel to fold line 132. Securement tab 60 defines interior free edge 142 and an opposite exterior free edge 144 each extending between an opposing end of fold line 132 to a different corresponding end of free edge 140. In one example, each of interior free edge 142 and exterior free edge 144 taper slightly inwardly (i.e., toward each other) as they extend from fold line 132 to free edge 140. In one example, each of fold line 132 and free edge 140 have at least slightly smaller lengths than slit 78.

While particular variations of the packaging wrap 14 layout are described herein, other embodiments will be apparent to those of skill in the art upon reading the present application. For example, while described as interior rear panel 50 and rear external panel 52, in other embodiments, which of rear panels 50 and 52 are interior and exterior may be otherwise arranged.

Figure 9:
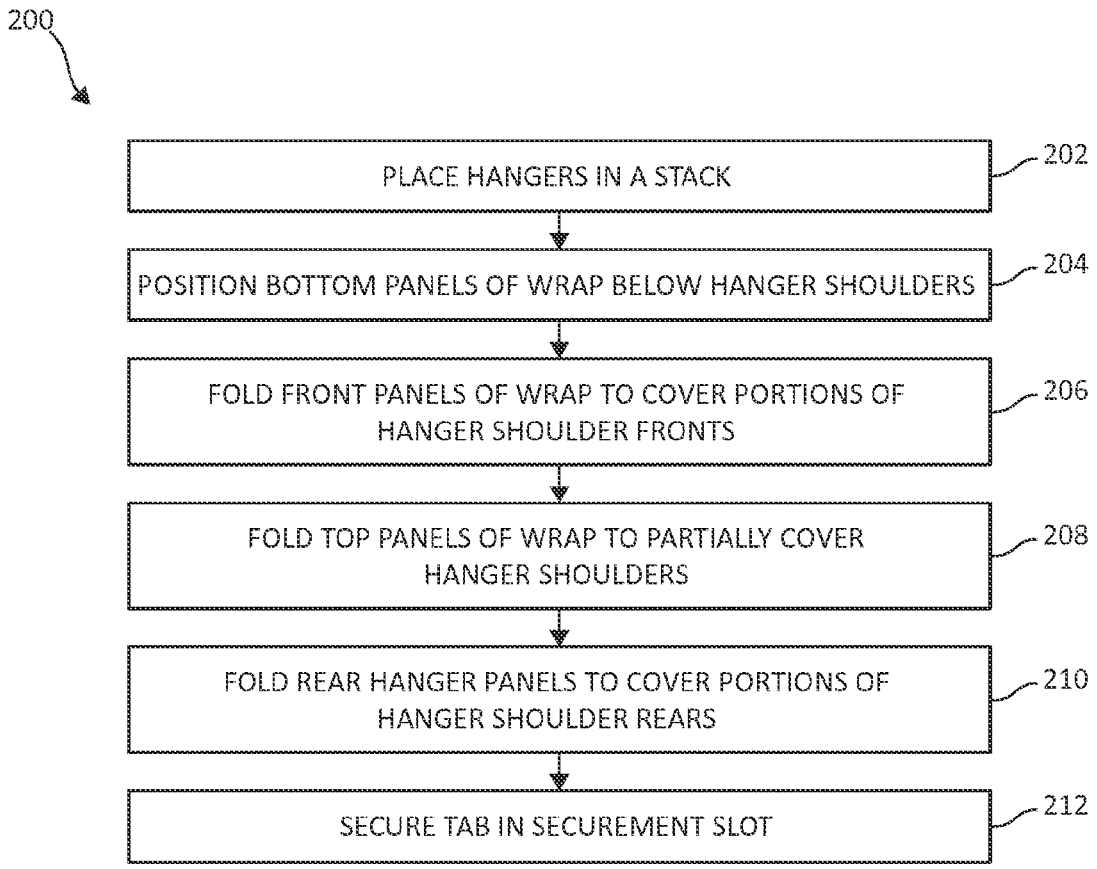
FIG. 9 is a flow chart illustrating a method of assembling the packaged hangers of FIG. 1, according to one embodiment of the present invention.

A method of assembling hanger package 10 is generally illustrated at 200 in FIG. 9. At 202, hangers 12 are placed in a stack, e.g., a horizontal stack. The number of hangers 12 placed in the stack is a number of hangers 12 that will be sold as a single product in a retail store, for example, six, twelve, eighteen, or twenty-four hangers 12. When placed in a stack, bodies 20, including shoulders 24, and hooks 22 of each hanger 12 aligns bodies, including shoulders 24, and hooks 22 of the other hangers 12 in the stack.

Figure 10:
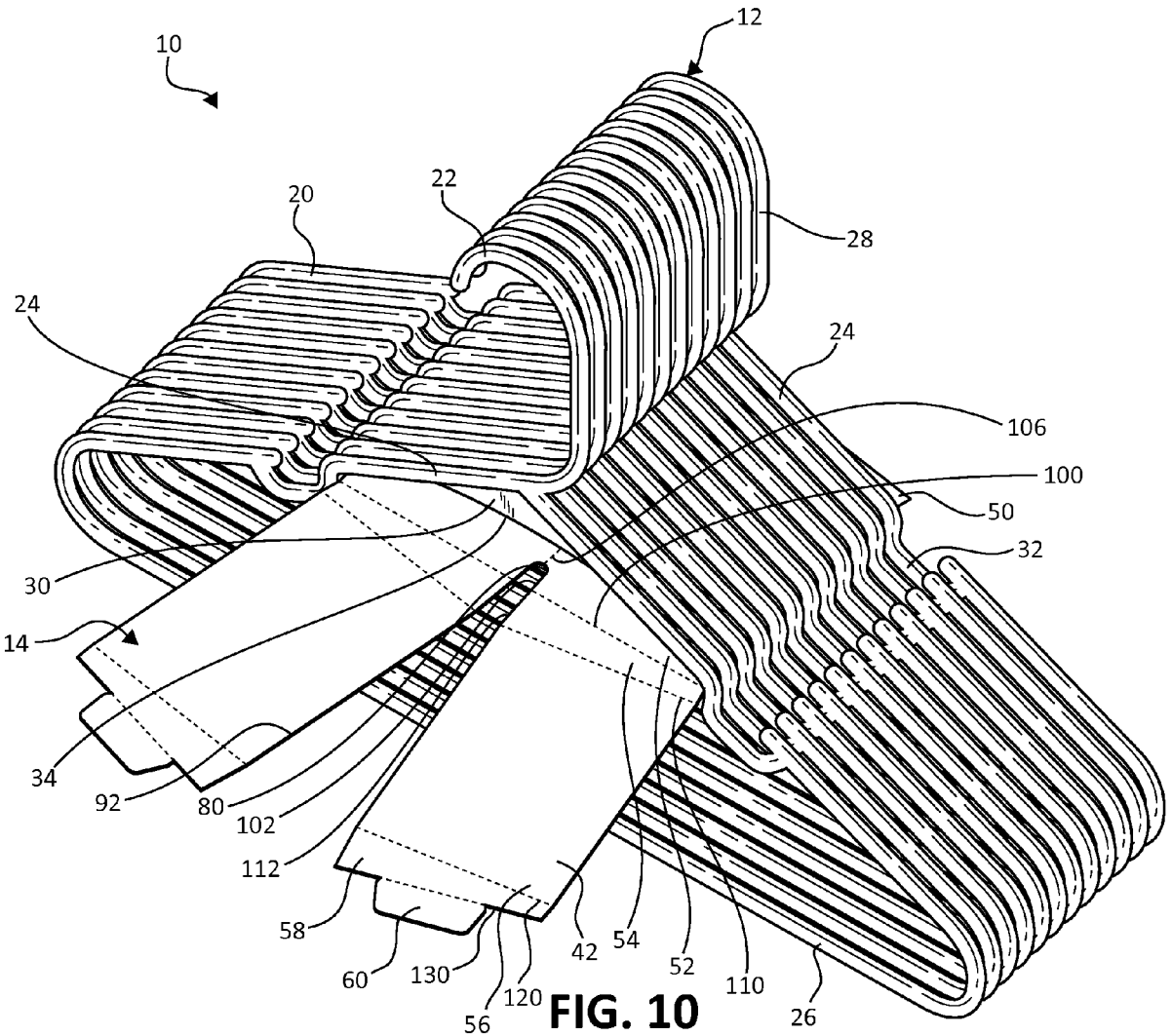
FIGS. 10-12 are front perspective view illustrations of various steps in the method of assembling of FIG. 9, according to one embodiment of the present invention.

At 204, packaging wrap 14 is initially positioned relative to hangers 12 as shown with additional reference to FIG. 10. For example, packaging wrap 14 is placed within opening 27 of body 20 such that interior surface 42 of packaging wrap 14 faces upwardly toward shoulders 24 and exterior surface 40 faces downwardly toward crossbar 26. Packaging wrap 14 is further moved until bottom panels 52 are positioned just below shoulders 24, more specifically, one bottom panel 52 on either side of neck 28, in one embodiment. In one example, bottom panels 52 are, at this or a later time during assembly, each folded slightly downwardly about fold line 106 to allow bottom panels 52 to more closely fit to the angle of shoulders 24 while maintaining their substantially planar configuration.

Figure 11:
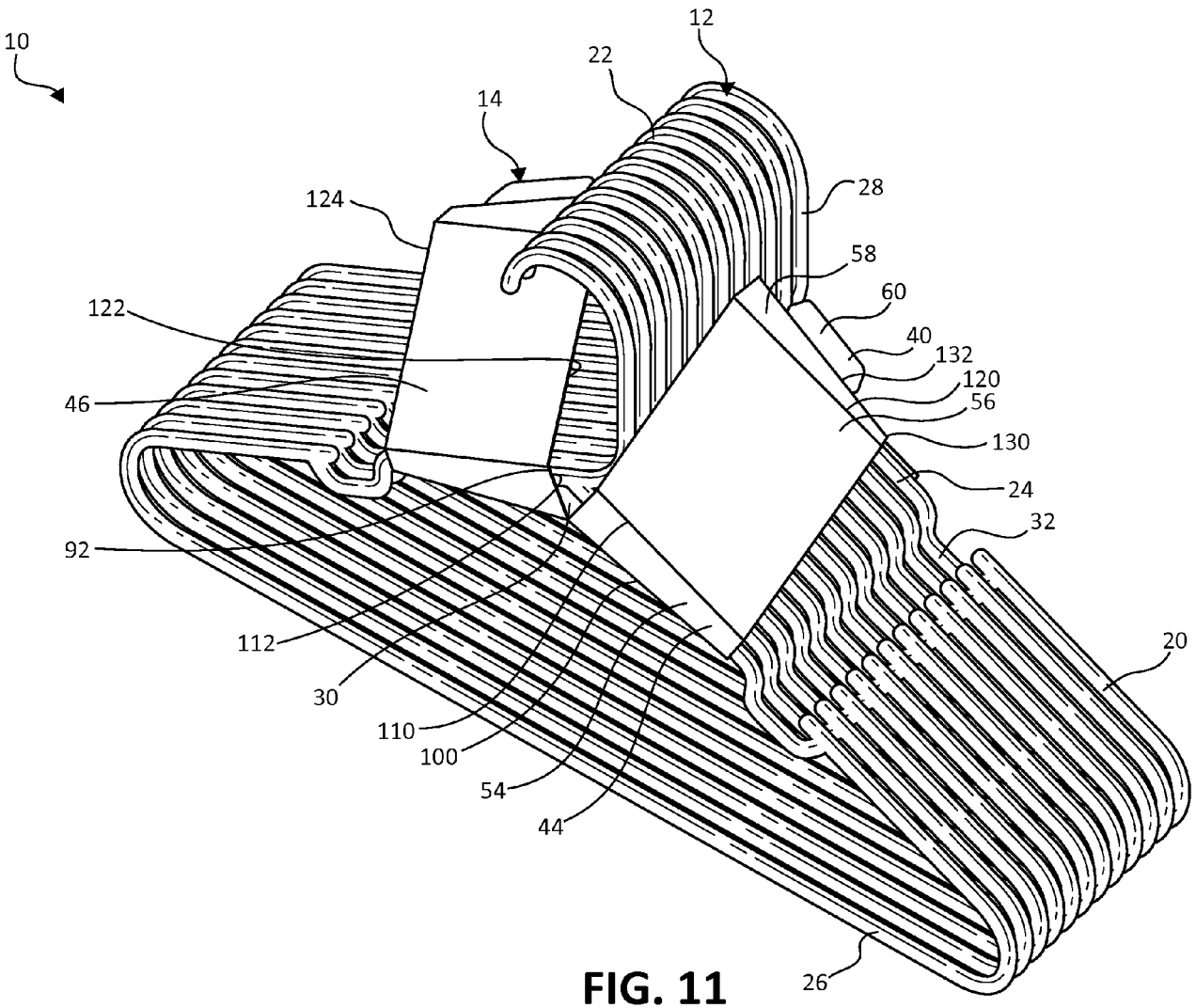

Then, at 206, front panels 54 are folded relative to corresponding bottom panels 52 about fold lines 100 to extend substantially perpendicularly relative to a corresponding one of bottom panels 52 and covering front portions of shoulders 24 of a front most one of hangers 12, as illustrated, for example, with additional reference to FIG. 11. Due to the flex of bottom panels 52 of first side 44 and second side 46 relative to one another about fold line 106, and interior free edges 102 and 122 extending forwardly from fold line 106, folding front panels 54 results in packaging wrap 14 splitting near a middle thereof to account for hooks 22 of hangers 12.

Figure 12:
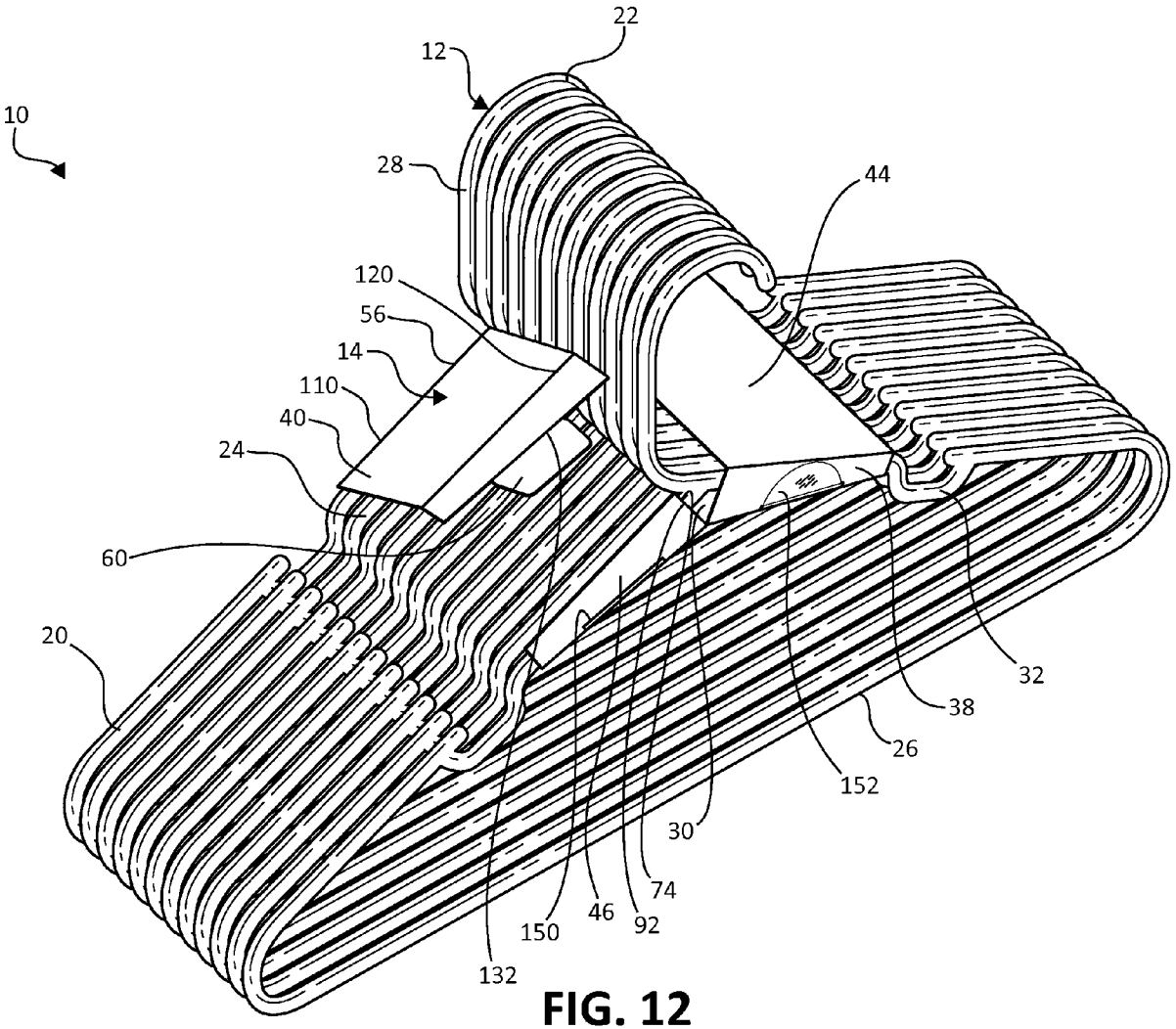

At 208, top panels 56 are each folded relative to front panels 54 about fold line 110 to extend substantially perpendicularly relative to front panels 54 covering tops of shoulders 24 of each of hangers 12 included in the stack being packaged as illustrated with additional reference to FIG. 12. At 210, interior rear panels 50 are folded upwardly relative to bottom panel 52 about fold line 72 followed by exterior rear panels 58 being folded downwardly relative to top panel 56 about fold lines 120. As such, interior rear panel 50 covers at least a first or bottom portion of a rear of the shoulder 24 of a rearmost one of hangers 12. Folding of interior rear panel 50 about fold line 72 results in formation of a slot 150 between fold lines 72, that is, along slit 78. Exterior rear panel 58 covers at least a second or top portion of the rear of the shoulder 24 of the rearmost one of hangers 12. Then, in one embodiment, at 212, securement tabs 60 are folded forwardly relative to corresponding exterior rear panels 58 about fold lines 132 and slid into corresponding slots 150 to secure packaging wrap 14 about hangers 12 on either side of necks 28 forming hanger package 10. In one example, a sticker or piece of tape 152 (FIG. 12) is placed over securement tab 60, a rear portion of bottom panel 52, and/or exterior rear panel 58 on each side 44 and 46 of packaging wrap 14 to further secure packaging wrap 14 in position around hangers 12.

Once packaging wrap 14 is secured around hangers 12, top panels 56 and bottom panels 52 are both maintained quite close to tops and bottoms of shoulders 24 of hangers 12, respectively, such that movement of hangers 12 between top panels 56 and bottom panels 52 is greatly restricted. In one example, while a small amount of movement or shifting of hangers 12 is allowed by packaging wrap 14, such movement is restricted such that hooks 22 of hangers 12 in packaging wrap 14 generally are maintained aligned such that the entire hanger package 10 can be hung on a support rod (not shown) by placing all hooks 22 over the support rod substantially simultaneously. The resultant hanger package 10 holds a plurality of hangers 12 in a neat stack providing area on packaging wrap 14 for indicia while generally only slightly impeding viewing of hangers 12.

Figure 13:
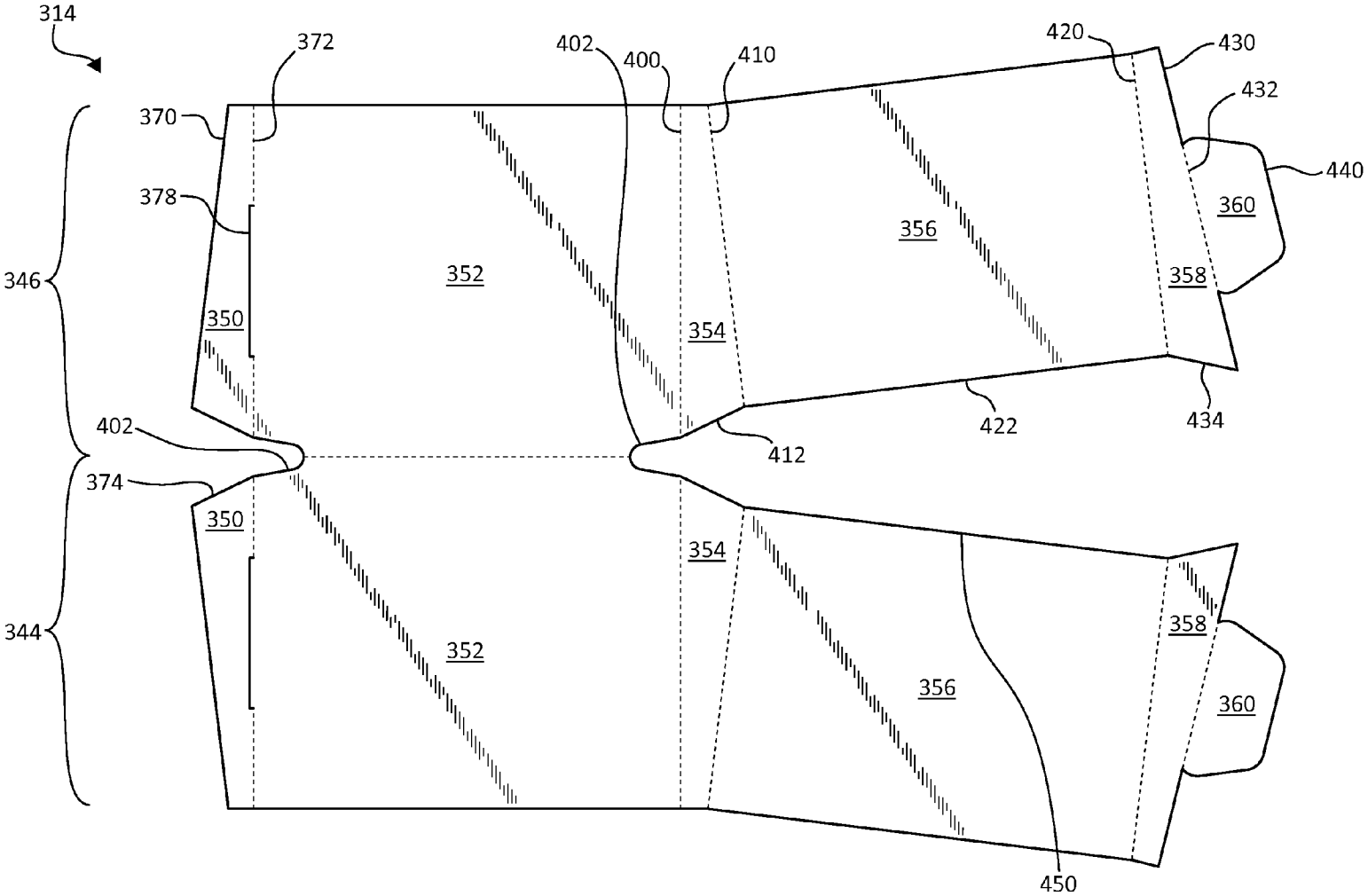
FIG. 13 is a front view illustration of an unfolded packaging wrap, according to one embodiment of the present invention.
Figure 14:
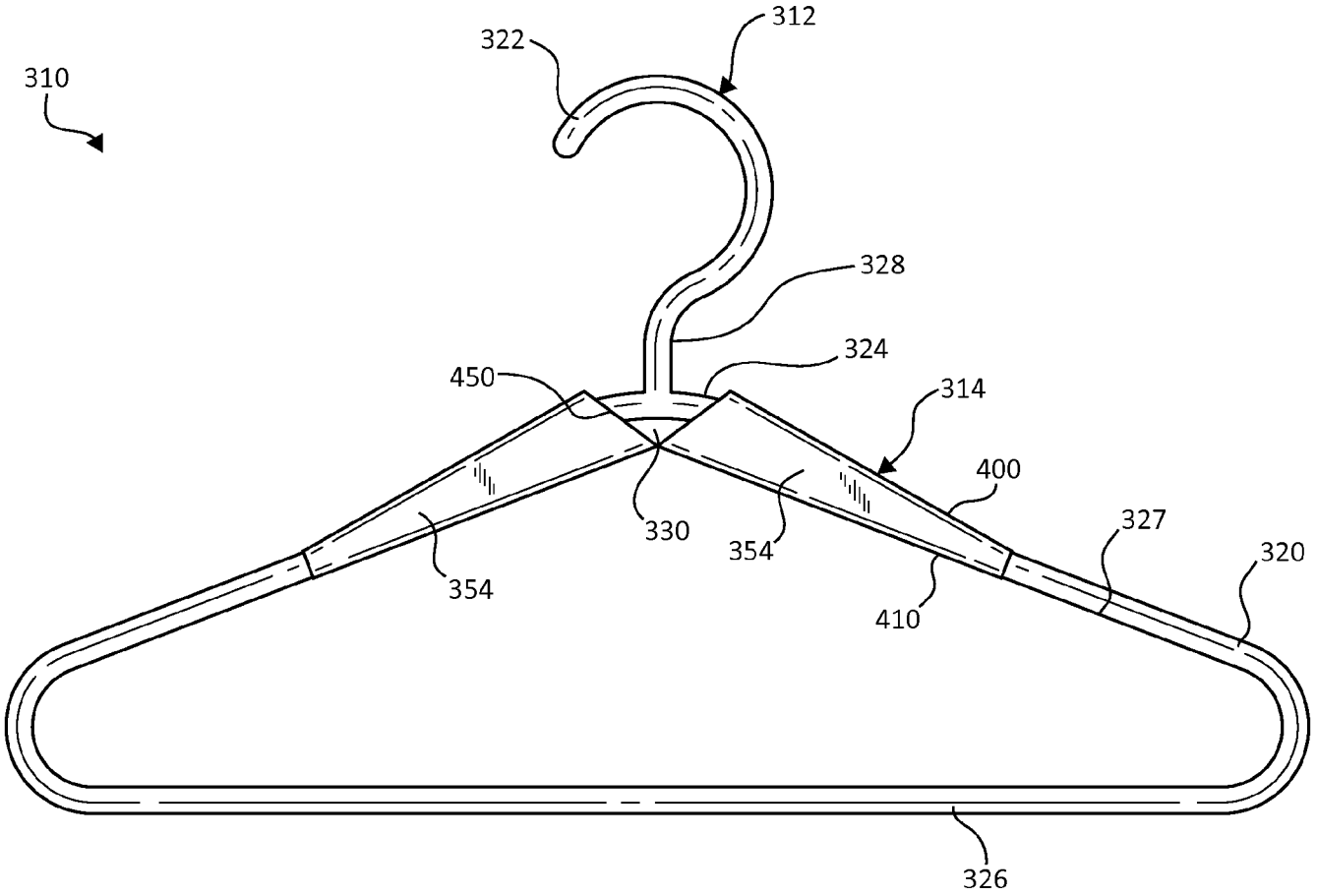
FIG. 14 is a front view illustration of packaged hangers including the packaging wrap of FIG. 13, according to one embodiment of the present invention.

Other embodiments of packaging wraps are also contemplated and may change, as will be apparent to those of skill in the art upon reading this application, with various configurations and specifics of the hangers being maintained by the corresponding packaging wrap. FIGS. 13 and 14 illustrate one example of a variation of a hanger package 310 with a hanger 312 and packaging wrap 314, which maintains all of hangers 312 as a single unit for sale and/or storage. Each one of the plurality of hangers 312 is substantially identical to the other ones of the plurality of hangers. In one embodiment, each of the plurality of hangers 312 includes a body 320 and a hook 322 extending upwardly therefrom. Body 320 is generally in the form of a triangular loop, in one example, in a manner defining shoulders 324 near the top vertex of the triangular loop, a crossbar 326 along a lower portion thereof, and an opening 327 formed between shoulders 324 and crossbar 326. In one example, an additional apex support 330 extends downwardly from the apex, i.e., the intersection between shoulders 324, to strengthen each of the plurality of hangers 312. Hook 322 includes a neck 328 extending from an intersection between shoulders 324 away from crossbar 326 to space a remainder of hook 322 from body 320.

Packaging wrap 314 is formed of a single piece of a substantially planar yet foldable material such as cardboard, paperboard, chipboard, plastic, etc., in one example, as illustrated in an unfolded state in FIG. 13. Packaging wrap 314 is substantially symmetrical defining a first side 344 and a second side 346, which is substantially a mirror image of first side 344. Packaging wrap 314 receives the plurality of hangers 312 substantially identically on either side of hooks 322 via first side 344 and second side 346. Each side 344 and 346 of packaging wrap 314 includes (i.e., is divided into) an interior rear panel 350, a bottom panel 352, a front panel 354, a top panel 356, an exterior rear panel 358, and a securement tab 360, according to one embodiment of the present invention. In one embodiment, interior rear panel 350, bottom panel 352, front panel 354, top panel 356, exterior rear panel 358, and securement tab 360 are sequentially positioned in an end-to-end manner on each of first side 344 and second side 346 with each successive one of the panels being differentiated by one or more fold lines 372, 400, 410, 420, and 432 between free edges 370, 430, and 440 in a manner substantially identical to how interior rear panel 50, bottom panel 52, front panel 54, top panel 56, exterior rear panel 58, and securement tab 60 of packaging wrap 14 (FIGS. 1-8 and 10-12) are differentiated by one or more fold lines 72, 100, 110, 120, and 132 between free edges 70, 130, and 140 as described above for packaging wrap 14 above except where specifically noted and/or illustrated herein.

More specifically, angles, dimensions, or other features of packaging wrap 314 differ from packaging wrap 14 to correspond with particular features of hangers 312 as compared to hangers 12 such a shoulder slope, dimensions, and other features thereof. For example, interior rear panel 350 defines interior free edge 374 to be angled more drastically away from the other side of packaging warp 312 such that interior rear panel 350 will be more fully hidden by exterior rear panel 358 upon assembly due to the particular shoulder slope and size of apex support 330 of hanger 312 as compared to hanger 12. For similar reasoning, interior free edge 434 of exterior rear panel 358 angles more drastically toward the opposite side 346 or 344 as it moves from fold line 420 to free edge 430 as compared to interior free edge 134. In addition, while interior free edges 102, 112, and 122 extend in a substantially linear fashion with only a slight outward angle along interior free edge 122, interior free edges 402, 412, and 422, are more visibly angled relative to one another, once again to account for the specific designs characteristics of hanger 12 while still presenting an aesthetically clean and pleasing end result to packaging wrap 314 when placed on the stack of hangers 312. Similar to how packaging wrap 14 defines gap 92 when flat that becomes an elongated opening for hooks 22 when folded, packaging wrap 314 also defines a gap 450 between interior free edges 412, 422, and 434, which becomes an elongated opening for hooks 322 of hangers 312.

Although the invention has been described with respect to particular embodiments, such embodiments are meant for the purposes of illustrating examples only and should not be considered to limit the invention or the application and uses of the invention. Various alternatives, modifications, and changes will be apparent to those of ordinary skill in the art upon reading this application. Furthermore, there is no intention to be bound by any theory presented in the preceding background of the invention or the above detailed description.

What is claimed is:

1. A packaging wrap for hangers, the packaging wrap comprising:

a first side including a first bottom panel, a first front panel, a first top panel, and a first rear panel, wherein the first front panel extends between the first bottom panel and the first top panel, the first top panel extends between the first front panel and the first rear panel, and the first side is folded to define a first closed loop with a first opening extending therethrough between the first bottom panel, the first front panel, the first top panel, and the first rear panel; and a second side including a second bottom panel, a second front panel, a second top panel, and a second rear panel, wherein the second front panel extends between the second bottom panel and the second top panel, the second top panel extends between the second front panel and the second rear panel, and the second side is folded to define a second closed loop with a second opening extending therethrough between the second bottom panel, the second front panel, the second top panel, and the second rear panel;

wherein the first side is coupled to the second side via a fold line extending along a boundary between the first bottom panel and the second bottom panel.

2. The packaging wrap of claim 1, wherein the packaging wrap defines an elongated opening between the first side and the second side opposite the fold line.

3. The packaging wrap of claim 1, wherein the packaging wrap is formed of a single piece of a substantially planar material folded to define each of the first bottom panel, the first front panel, the first top panel, the first rear panel, the second bottom panel, the second front panel, the second top panel, and the second rear panel.

4. The packaging wrap of claim 1, wherein the first side is only coupled to the second side along the fold line.

5. The packaging wrap of claim 1, wherein when the first side forms the first closed loop, the first front panel extends substantially perpendicularly relative to each of the first bottom panel and the first top panel.

6. The packaging wrap of claim 1, wherein the first side further includes a securement tab extending from the first rear panel and a slot adjacent the first bottom panel, and the securement tab is selectively received within the slot to secure the first side in a position defining the first closed loop.

7. The packaging wrap of claim 1, in combination with a stack of hangers at least partially maintained within each of the first closed loop and the second closed loop.

8. The combination of claim 7, wherein the packaging wrap defines an elongated opening between the first side and the second side opposite the fold line, each hanger in the stack of hangers includes a hook, and each hook extends through the elongated opening.

9. The combination of claim 8, wherein each hanger in the stack of hangers includes two opposing shoulders, and one of the two opposing shoulders of each hanger in the stack of hangers is placed in a different one of the first closed loop and the second closed loop.

10. The combination of claim 7, wherein each hanger in the stack of hangers includes a body defining a body opening, the body openings of all of the hangers in the stack of hangers align with one another, and the first bottom panel and the second bottom panel each extend through the openings of all of the hangers in the stack of hangers.

11. The combination of claim 10, wherein the first bottom panel and the second bottom panel each extend from the fold line downwardly away from one another.

12. The combination of claim 10, wherein the body of each hanger in the stack of hangers defines two shoulders, and the first top panel and the second top panel each extend over a different one of the two shoulders opposite a respective one of the first bottom panel and the second bottom panel.

13. The combination of claim 7, wherein:

the packaging wrap defines an elongated opening between the first side and the second side opposite the fold line, each hanger in the stack of hangers includes a hook, each hook extends through the elongated opening, each hanger in the stack of hangers includes two opposing shoulders, one of the two opposing shoulders of each hanger in the stack of hangers is placed in a different one of the first closed loop and the second closed loop, each hanger in the stack of hangers includes a body defining a body opening, the body openings of all of the hangers in the stack of hangers align with one another, and the first bottom panel and the second bottom panel each extend through the openings of all of the hangers in the stack of hangers.

14. A package for maintaining a plurality of hangers, the package comprising:

means for encircling a first shoulder of each of the plurality of hangers;

means for encircling a second shoulder of each of the plurality of hangers;

wherein the means for encircling the first shoulder and the means for encircling the second shoulder are directly coupled to one another below each of the first shoulders and each of the second shoulders opposite a hook of the each of the plurality of hangers; and means for allowing hooks of each of the plurality of hangers to extend through the package between the means for encircling the first shoulder and the means for encircling the second shoulder.

15. The package of claim 14, wherein the package is entirely formed of a single piece of a substantially planar material folded to form the means for encircling the first shoulder and the means for encircling the second shoulder.

16. The package of claim 14, wherein the means for encircling the first shoulder and the means for encircling the second shoulder impede movement of each of the plurality of hangers such that the hooks of the plurality of hangers are maintained in positions aligned with one another.

17. The package of claim 14, further comprising means for coupling the means for encircling the first shoulder and the means for encircling the second shoulder in a manner allowing adjustment of an angle the means for encircling the first shoulder extends from the means for encircling the second shoulder.

* * * * *